US009227806B2

(12) United States Patent
Chiba

(10) Patent No.: US 9,227,806 B2
(45) Date of Patent: Jan. 5, 2016

(54) IMAGE FORMING APPARATUS

(71) Applicant: CANON KABUSHIKI KAISHA, Tokyo (JP)

(72) Inventor: Yoshinao Chiba, Toride (JP)

(73) Assignee: Canon Kabushiki Kaisha, tokyo (JP)

( * ) Notice: Subject to any disclaimer, the term of this patent is extended or adjusted under 35 U.S.C. 154(b) by 0 days.

(21) Appl. No.: 14/580,409

(22) Filed: Dec. 23, 2014

(65) Prior Publication Data

US 2015/0191322 A1 Jul. 9, 2015

(30) Foreign Application Priority Data

Jan. 9, 2014 (JP) ..... 2014-002467

(51) Int. Cl.

| | |
|---|---|
| ***B65H 1/00*** | (2006.01) |
| ***B65H 7/02*** | (2006.01) |
| ***B65H 1/04*** | (2006.01) |
| ***B65H 7/20*** | (2006.01) |

(52) U.S. Cl.

CPC .. *B65H 7/02* (2013.01); *B65H 1/04* (2013.01); *B65H 7/20* (2013.01); *B65H 2405/1122* (2013.01); *B65H 2405/31* (2013.01)

(58) Field of Classification Search

CPC .... B65H 1/00; B65H 1/04; B65H 2405/1122; B65H 2405/31; B65H 7/02; B65H 7/20

USPC ..... 271/171

See application file for complete search history.

(56) References Cited

U.S. PATENT DOCUMENTS

| | | | | |
|---|---|---|---|---|
| 5,655,764 | A * | 8/1997 | Ota et al. | 271/171 |
| 5,927,707 | A * | 7/1999 | Miura | 271/171 |
| 6,254,085 | B1 * | 7/2001 | Kang | 271/171 |
| 6,826,383 | B2 * | 11/2004 | Yano | 399/389 |
| 7,413,188 | B2 * | 8/2008 | Miki | 271/171 |
| 7,441,769 | B2 * | 10/2008 | Miki | 271/171 |
| 7,635,129 | B2 * | 12/2009 | Inoue | 271/258.01 |
| 7,694,960 | B2 * | 4/2010 | Sing | 271/171 |

(Continued)

FOREIGN PATENT DOCUMENTS

JP 2007-204249 8/2007

OTHER PUBLICATIONS

U.S. Appl. No. 14/465,858, filed Aug. 22, 2014, to Yoshinao Chiba et al.

(Continued)

*Primary Examiner* — David H Bollinger

(74) *Attorney, Agent, or Firm* — Fitzpatrick, Cella, Harper & Scinto

(57) ABSTRACT

A sheet storing portion includes a movable restricting portion disposed in a sheet storage body to be movable along a sheet feeding direction and restricting an upstream end in the sheet feeding direction of the sheet. A detecting portion moves in conjunction with the movable restricting portion and includes a detecting member that turns turning on and off the plurality of switches. A control portion is configured to judge the size of the sheet by patterns of ON and OFF of the plurality of switches inputted from the detecting portion and to judge that the size of the sheet stored in the sheet storing portion is the sheet specified through a specifying portion when the size of the sheet is specified through the specifying portion even if the pattern is a predetermined pattern different from a pattern of the size of the sheet specified through the specifying portion.

12 Claims, 9 Drawing Sheets

(56) References Cited

U.S. PATENT DOCUMENTS

| | | | | |
|---|---|---|---|---|
| 8,061,708 | B2 * | 11/2011 | Fujita et al. | 271/171 |
| 8,651,477 | B2 | 2/2014 | Chiba | |
| 2006/0087073 | A1 * | 4/2006 | Yamagishi | 271/171 |
| 2009/0051101 | A1 * | 2/2009 | Yamagishi | 271/171 |

OTHER PUBLICATIONS

U.S. Appl. No. 14/525,507, filed on Oct. 28, 2014, to Toshiki Ishida et al.

* cited by examiner

FIG.6

| SHEET SIZE (SWITCH PATTERN) | POSITIONAL RELATIONSHIP BETWEEN SIZE DETECTING PLATE AND SIZE DETECTING SWITCH |
|---|---|
| A5 (1) (1,1,0) | |
| B5 (2) (1,0,0) | |
| EXEC (2)or(3) (1,0,0)or(1,0,1) | |
| 16K (3)or(4) (1,0,1)or(0,0,1) | |
| LTR (4)or(5) (0,0,1)or(0,0,0) | |
| A4 (6) (0,1,0) | |
| LGL (7) (0,1,1) | |

IMAGE FORMING APPARATUS

BACKGROUND OF THE INVENTION

1. Field of the Invention

The present invention relates to an image forming apparatus and more specifically to a configuration for detecting a size of a sheet stored in a sheet storage portion.

2. Description of the Related Art

Conventionally, there is known an image forming apparatus such as a copier, a laser beam printer or the like configured to be able to attach a universal cassette, i.e., a sheet storing portion, capable of storing different sizes of sheets. Here, a sheet size detecting portion configured to detect sizes of the stored sheets is required to use the universal cassette.

As such a sheet size detecting portion, Japanese Patent Application Laid-open No. 2007-204249 discloses one using a plurality of switches. The sheet size detecting portion includes the plurality of switches provided in a body of the image forming apparatus, a sheet restricting portion provided in a sheet feeding cassette and movable corresponding to sheet sizes, and a sheet size detecting member moving in conjunction with the sheet restricting portion. The sheet size detecting portion is configured to discriminate the sheet sizes by combinations of ON and OFF, i.e., by switch patterns, of the plurality of switches turned ON and OFF by the sheet size detecting member interlocked with the sheet restricting portion moving to a position corresponding to the sheet size when the sheet feeding cassette is attached to the body of the image forming apparatus.

By the way, in a case of discriminating whether the size of a stored sheet is size A or size B (assumed to be A<B) by using such a mechanism, a point for switching the switch patterns is set between the sizes A and B. Then, if a switch pattern at a position under the switching point is detected, the size of the stored sheet is discriminated to be the size A, and if a switch pattern at a position above the switch pattern is detected, the size of the stored sheet is discriminated to be the size B.

In a case where the sheet sizes are close, i.e., in a case where lengths in the sheet feeding direction of sheets (referred to as a 'sheet length' hereinafter) are close, the switching point is set within a very narrow range in such a conventional image forming apparatus. For instance, a difference of sheet lengths is only 4 mm between a 16K size sheet (270 mm in sheet length) and an EXEC size sheet (266 mm in sheet length). In this case, the switching point of the switch pattern is set within the range of 4 mm in discriminating the size only by a position of the sheet restricting portion, i.e., a sheet rear end restricting member.

For instance, there is a case where the switch pattern is set to be switched upstream by 2 mm of a rear end of the EXEC size sheet. In this case, if a user of the image forming apparatus erroneously sets the rear end restricting member by displacing by several mm in setting the EXEC size sheet, the stored sheet is discriminated to be the 16K size sheet.

If size information of the sheet to be used by the user and inputted from a personal computer or the like is different from the sheet size detected by the sheet size detecting unit, conventionally it results in an error in general. Conventionally, while there is known a sheet feeder that is capable of feeding a sheet even if the rear end restricting member is displaced by several mm, the sheet feeder is controlled so as not to feed the sheet even if it is mechanically capable of feeding the sheet if the error occurs.

That is, even though the sheet can be fed mechanically, the sheet cannot be fed if the setting position of the rear end restricting member is displaced by several mm. In the case where the difference of the sheet lengths is thus small, an allowance of the displacement of the rear end restricting member becomes small because the switching point is set within a very narrow range.

SUMMARY OF THE INVENTION

According to one aspect of the invention, an image forming apparatus includes an apparatus body; a sheet storing portion including: a sheet storage body configured to be attachable to the apparatus body and capable of storing a different sizes of sheets; and a movable restricting portion disposed in the sheet storage body to be movable along a sheet feeding direction and restricting an upstream end in the sheet feeding direction of the sheet; a specifying portion configured to specify the size of the sheet stored in the sheet storing portion; a detecting portion including: a plurality of switches provided in the apparatus body and a detecting member provided in the sheet storing portion, moving in conjunction with the movable restricting portion and turning on and off the plurality of switches in the state in which the sheet storing portion is attached to the apparatus body and a control portion judging the size of the sheet by patterns of ON and OFF of the plurality of switches inputted from the detecting portion and judging that the size of the sheet stored in the sheet storing portion is the size of the sheet specified through the specifying portion when the size of the sheet is specified by the specifying portion even if the pattern is a predetermined pattern different from a pattern of the size of the sheet specified by the specifying portion.

Further features of the present invention will become apparent from the following description of exemplary embodiments (with reference to the attached drawings).

BRIEF DESCRIPTION OF THE DRAWINGS

FIG. 6 is a table arranging sheet sizes, switch patterns to be detected, and positional relationships between a size detecting plate and size detecting switches in the sheet size detecting portion.

DESCRIPTION OF THE EMBODIMENTS

Figure 1:
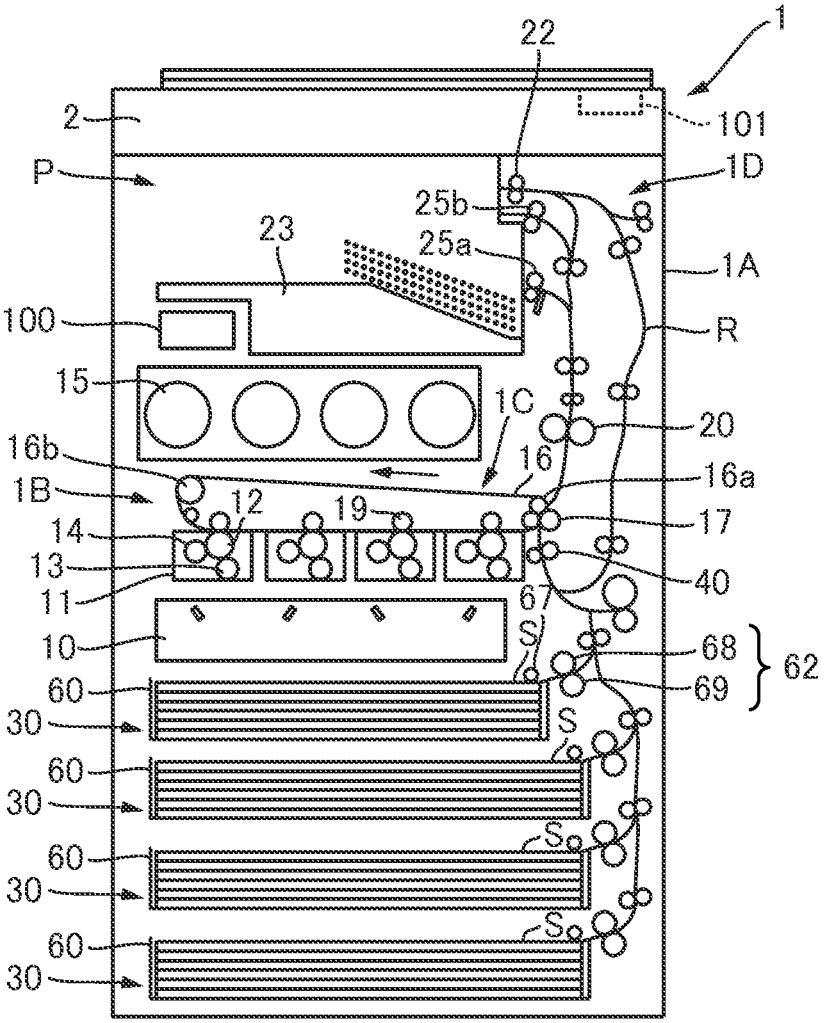
FIG. 1 is a diagram schematically showing a configuration of a full-color laser beam printer which is one exemplary image forming apparatus according to an embodiment of the present invention.

Modes for carrying out the present invention will be detailed with reference to the drawings. FIG. 1 is a diagram schematically showing a configuration of a full-color laser beam printer (referred simply as a 'printer' hereinafter) 1 which is one exemplary image forming apparatus of the embodiment of the present invention. In FIG. 1, a printer body 1A is an apparatus body, and an image forming portion 1B configured to form an image on a sheet S. An image reader 2 is provided substantially horizontally above the printer body 1A and a discharge space P for discharging a sheet is provided between the image reader 2 and the printer body 1A.

The printer 1 also includes a sheet feeder 30 including a sheet feeding cassette 60, i.e., a sheet storage portion, configured to store the sheet S, a pickup roller 67, i.e., sheet feeding portion, configured to feed the sheet S from the sheet feeding cassette 60, and a separating portion 62 configured to separate the sheet S delivered from the pickup roller 67. The separating portion 62 includes a feed roller 68 and a retard roller 69.

The image forming portion 1B is of a four-drum full-color type and includes a laser scanner 10 and four process cartridges configured to form four color toner images of yellow (Y), magenta (M), cyan (C) and black (K). Here, each of the process cartridges 11 includes a photosensitive drum 12, a charger 13, and a developer 14. The image forming portion 1B also includes an intermediate transfer unit 1C and a fixing portion 20 disposed above the process cartridges 11. The printer 1 also includes toner cartridges 15 for supplying toner to the developer 14.

The intermediate transfer unit 1C includes an intermediate transfer belt 16 wrapped around a driving roller 16*a* and a tension roller 16*b*, and primary transfer rollers 19 provided inside of the intermediate transfer belt 16 and being in contact with the intermediate transfer belt 16 at positions facing to the photosensitive drums 12. Here, the intermediate transfer belt 16 is rotated in a direction of an arrow in FIG. 1 by the driving roller 16*a* driven by a driving portion not shown.

Then, the respective color toner images having negative polarity and formed on the photosensitive drums 12 are transferred and superimposed sequentially to the intermediate transfer belt 16 by the primary transfer rollers 19. A secondary transfer roller configured to transfer the color images formed on the intermediate transfer belt 16 to the sheet S is provided at a position facing to the driving roller 16*a* of the intermediate transfer unit 1C. The fixing portion 20 is disposed above the secondary transfer roller 17, and first and second discharge roller pairs 25*a* and 25*b* and a double-side reversing portion 1D are disposed above the fixing portion 20. The double-side reversing portion 1D is provided with a reverse roller pair 22 capable of rotating in normal and reverse directions, a re-conveying passage R and others configured to convey the sheet S on which the image has been formed on one surface thereof to the image forming portion 1B again.

The printer 1 also includes a control portion 100 configured to control the image forming operation of the image forming portion 1B, the sheet feeding operation of the sheet feeder 30 and others and an operation portion 101 including an operation panel and others not shown. A user of the image forming apparatus specifies a size of the sheet S through the operation portion 101 and the specified size of the sheet S is inputted to the control portion 100 as described later.

Next, the image forming operation of the printer 1 will be explained. Firstly, image information of a document is read by the image reader 2. Then, the image information is image-processed and is converted into electrical signals to be transmitted to the laser scanner 10 of the image forming portion 1B. In the image forming portion 1B, a surface of each photosensitive drum 12 which has been homogeneously charged with predetermined polarity and potential by the charger 13 is exposed sequentially by a laser beam of the laser scanner 10. Thereby, electrostatic latent images of yellow, magenta, cyan and black are sequentially formed on the photosensitive drums 12 of the respective process cartridges 11.

After that, the electrostatic latent images are developed and visualized by toners of the respective colors and the toner images of the respective colors on the respective photosensitive drums 12 are sequentially transferred and superimposed on the intermediate transfer belt 16 by a primary transfer bias applied to the primary transfer rollers 19. Thereby, the toner images are formed on the intermediate transfer belt 16. Still further, in parallel with this toner image forming operation, the sheet S stored in the sheet feeding cassette 60 is delivered by the pickup roller 67 provided in the sheet feeder 30. The delivered sheet S is separated one by one by the separating portion 62 including the feed roller 68 and the retard roller 69 and is conveyed to a registration roller pair 40. The registration roller pair 40 corrects a skew of the sheet S.

After the correction of the skew, the sheet S is conveyed by the registration roller pair 40 to the secondary transfer roller 17, and the toner images are collectively transferred to the sheet S by a secondary transfer bias applied to the secondary transfer roller 17. The sheet S on which the toner images have been transferred is then conveyed to the fixing portion 20. The toners of the respective colors melt and mix with each other by receiving heat and pressure in the fixing portion 20 and are fixed as a full-color image on the sheet S.

After that, the sheet S on which the image has been fixed is discharged to the discharge space P by the first and second discharge roller pairs 25*a* and 25*b* provided downstream of the fixing portion 20 and is stacked on a stacking portion 23 provided at an under part of the discharge space P. It is noted in a case where images are to be formed on both surfaces of the sheet S, the sheet S on which the image has been fixed is conveyed to the re-conveying passage R by the reverse roller pair 22 to be conveyed again to the image forming portion 1B.

Figure 2:
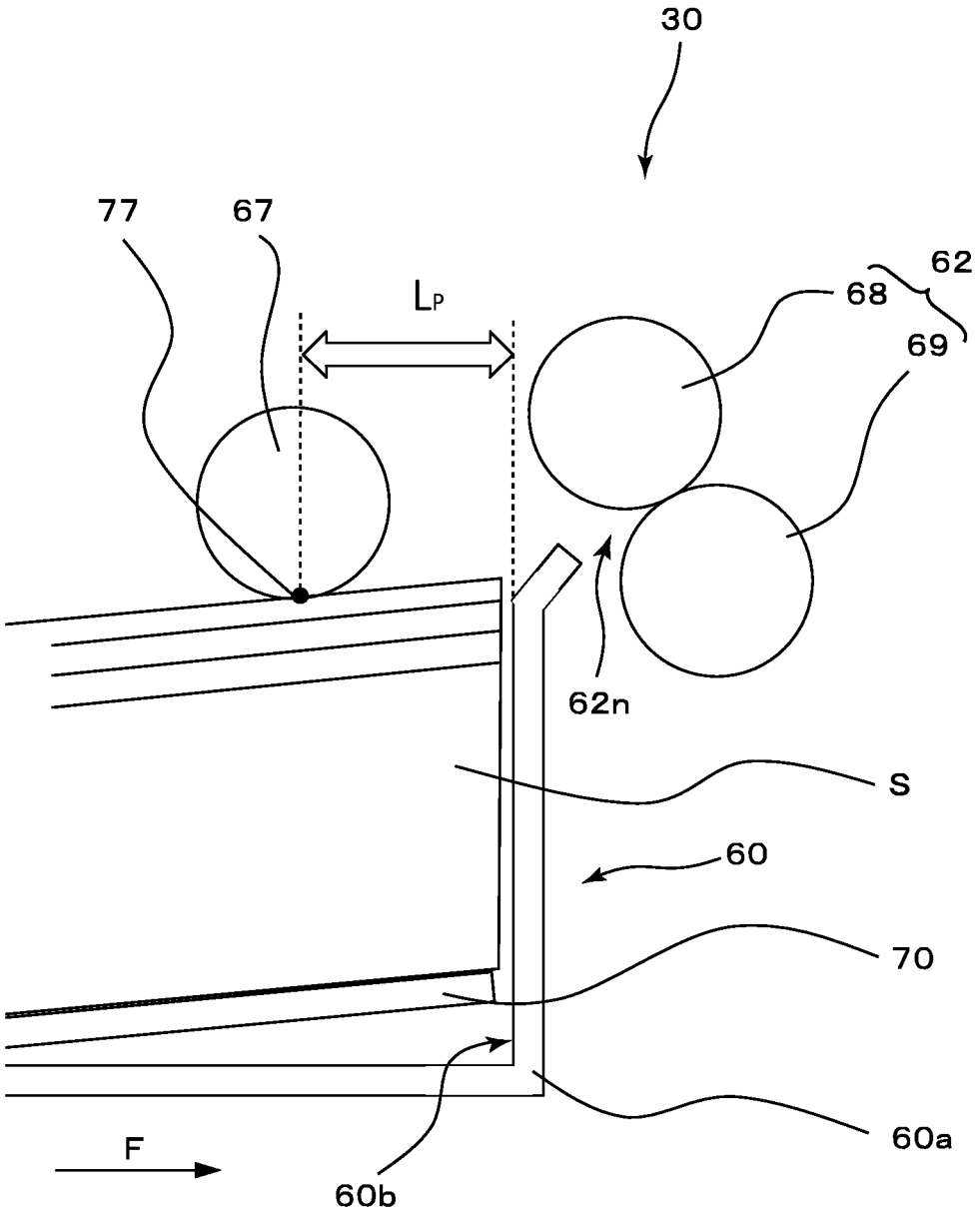
FIG. 2 is a diagram schematically illustrating a configuration of a sheet feeder provided in the full-color laser beam printer.

FIG. 2 is a diagram schematically illustrating a configuration of the sheet feeder 30 of the present embodiment. As shown in FIG. 2, the sheet feeder 30 includes a cassette body 60*a* composing a sheet storage portion of the sheet feeding cassette 60 configured to be attachable to the printer body 1A. The sheet feeding cassette 60 includes a stacking tray (middle plate) 70 provided within the cassette body 60*a* and supported to be vertically turnable on a support pivot not shown.

Then, when the sheet feeding cassette 60 is attached to the printer body 1A, the stacking tray 70 is lifted by a lift mechanism not shown. Thereby, the sheet S comes into contact with the pickup roller 67, and the pickup roller 67 and the feed roller 68 rotate by a driving force given from a feed motor not shown. Thereby, the sheet S is fed by the pickup roller 67 to a separation nip portion 62*n* formed by a press-contact arrangement of the feed roller 68 and the retard roller 69 to be separated one by one and is then conveyed to the image forming portion 1B.

Figure 3:
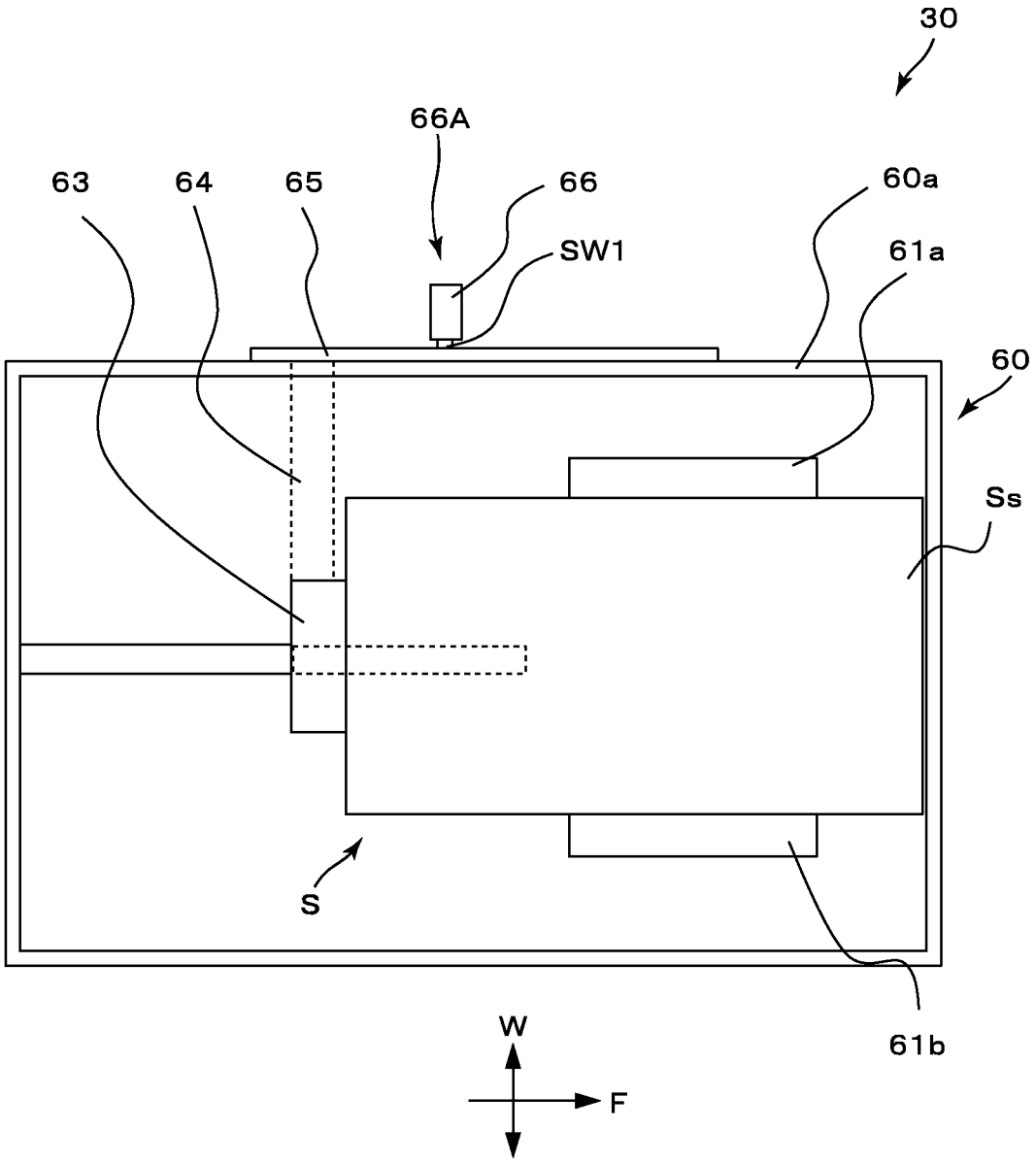
FIG. 3 is a diagram schematically illustrating a configuration of a sheet feeding cassette attached to the full-color laser beam printer.

As shown in FIG. 3, the sheet feeding cassette 60 includes side end restricting members 61*a* and 61*b* supported slidably (movably) in a width direction W orthogonal to the sheet feeding direction F and positioning both widthwise side ends of the sheet S. The side end restricting members 61*a* and 61*b* respectively have rack portions not shown and engaging with a pinion gear not shown disposed at a widthwise W center of the cassette body 60*a*, respectively. This arrangement makes it possible to operate the side end restricting members 61*a* and 61*b* symmetrically centering on the pinion gear and to position the widthwise side ends of the sheet S from what having a minimum sheet width size to what having a maximum sheet width size.

The sheet feeding cassette 60 also includes a rear end restricting member 63, i.e., a movable restricting portion, supported within the cassette body 60*a* slidably to upstream and downstream sides in the sheet feeding direction F and positioning and restricting a position of a rear end, i.e., an upstream end in the sheet feeding direction F of the sheet S. The rear end restricting member 63 is connected with a size detecting plate 65 through an intermediary of a link member 64. Then, when the rear end restricting member 63 is moved corresponding to a sheet size, the size detecting plate 65 moves in conjunction with the move of rear end restricting member 63 in parallel with a direction in which the rear end restricting member 63 moves through the intermediary of the link member 64. This arrangement makes it possible to store sheets of a plurality of different sizes in the cassette body 60*a*.

It is noted that in FIG. 3, the printer body 1A is provided with a sensor portion 66, and a sheet size detecting portion (detecting portion) 66A configured to detect sizes of the sheets S stored in the sheet feeding cassette 60 is composed of the sensor portion 66 and the size detecting plate 65 in the present embodiment. Here, the sensor portion 66 includes a plurality of switches, e.g., three switches SW1, SW2, and SW3 in the present embodiment, as shown in FIG. 4.

Figure 4:
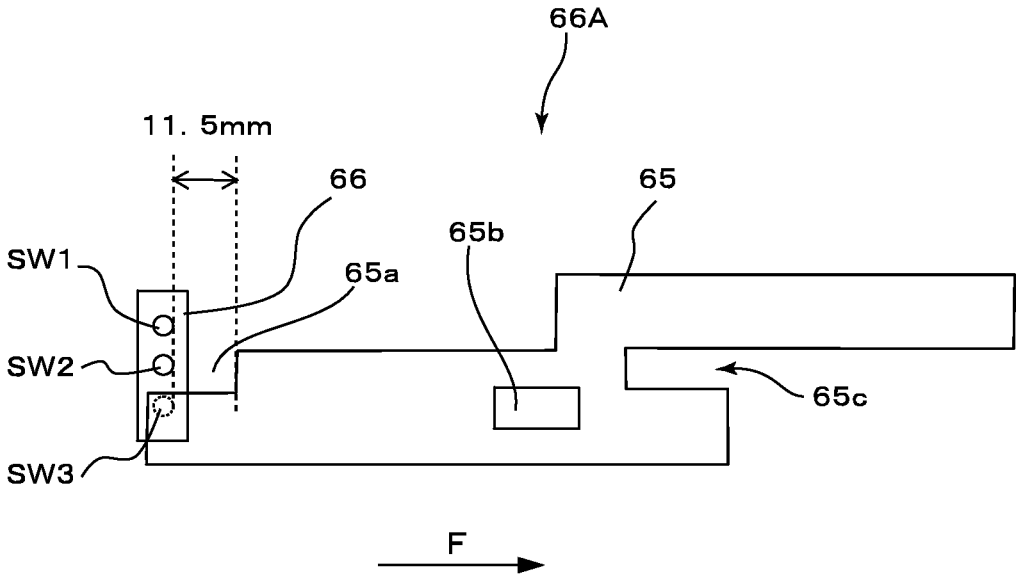
FIG. 4 is a diagram schematically illustrating a configuration of a sheet size detecting portion provided in the full-color laser beam printer.

As shown also in FIG. 4, the size detecting plate 65, i.e., a detecting member, is provided with a cut-away part 65*a*, a hole 65*b*, and a slit 65*c*. Then, when the sheet feeding cassette is inserted into the printer body 1A, either one or the plurality of the three switches SW1, SW2, and SW3 are turned ON by being pressed by the size detecting plate 65 moving in a body with the rear end restricting member 63 to a position corresponding to a sheet size.

It is noted that in the present embodiment, the sizes of the sheets S that can be stored in the sheet feeding cassette 60 are A5 (210 mm in length in a conveying direction×148 mm in width), B5 (257 mm in length×182 mm in width), EXEC (266.7 mm in length×184.1 mm in width), 16K (270 mm in length×195 mm in width), LTR (279.4 mm in length×215.9 mm in width), A4 (297 mm in length×210 mm in width), and LGL (355.6 mm in length×215.9 mm in width).

FIG. 4 shows a state in which the sheet feeding cassette 60 in a state in which the rear end restricting member 63 is set at a normal position after storing the A5 size sheets S is attached to the printer body 1A. In this case, only the switch SW3 is turned ON by being pressed by the size detecting plate 65. Thus, patterns of combinations (switch patterns, patterns) of ON and OFF of the three switches SW1, SW2, and SW3 are switched by the position of the size detecting plate 65.

Here, the three switches SW1, SW2, and SW3 are connected to the control portion 100. Then, the control portion 100 detects the size of the sheet S stored in the sheet feeding cassette 60 by the switch patterns switched by the position of the rear end restricting member 63 whose position is changed corresponding to the sheet size.

Figure 5:
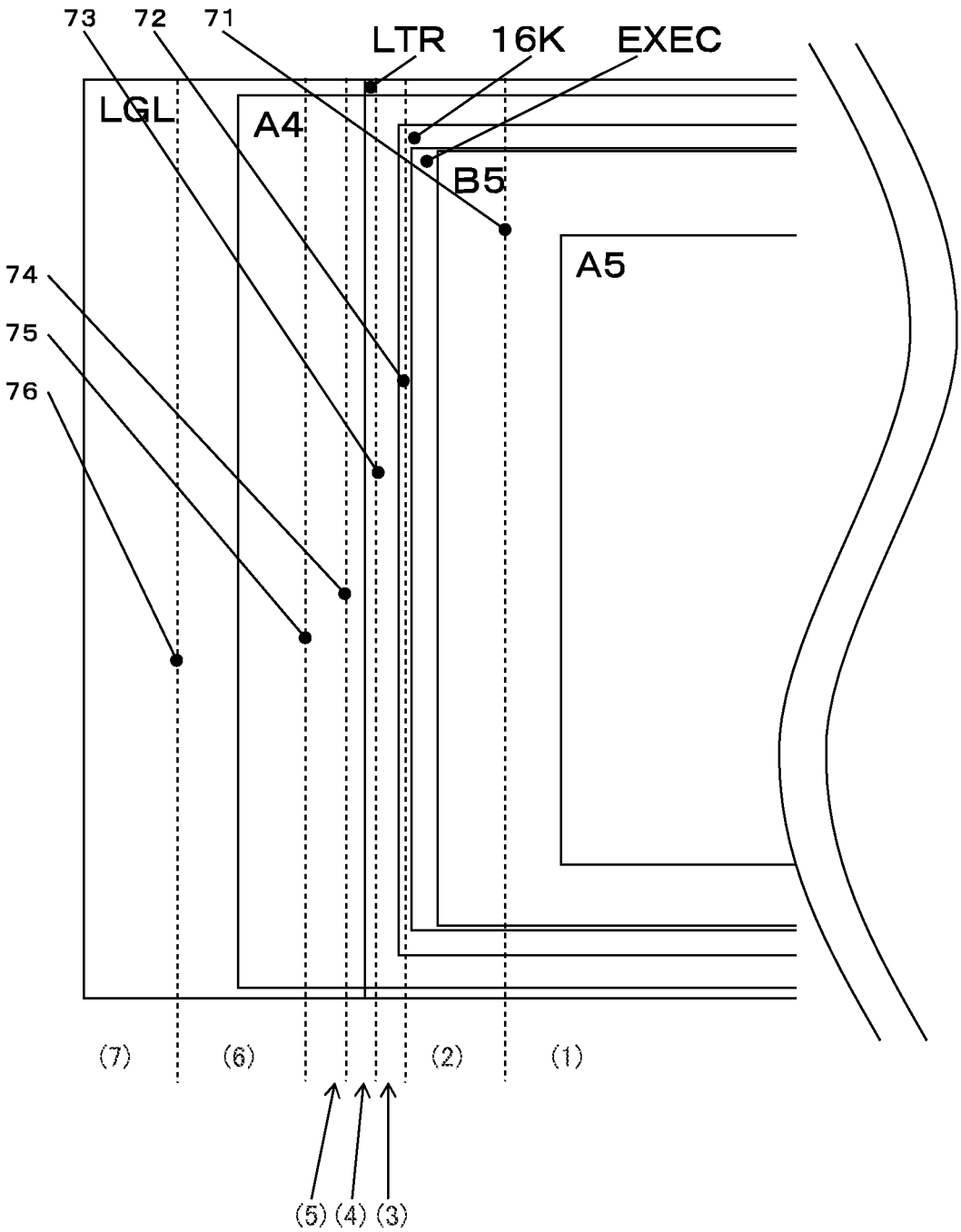
FIG. 5 is a diagram illustrating positions where switch pattern switching points of the sheet size detecting portion are set.

FIG. 5 is a diagram of switch pattern detecting switch points of the present embodiment. The switch patterns include seven, i.e., (1) to (7), steps and are switched respectively when the rear end restricting member 63 moves to the switch pattern switching points 71 to 76. Table 1 below indicates specific switching positions.

TABLE 1

| Switching Point No. | Switching Position (Distance from Inner Wall Surface of Cassette) |
|---|---|
| 71 | 221.5 mm |
| 72 | 268.5 mm |
| 73 | 278.2 mm |
| 74 | 281.5 mm |
| 75 | 290.9 mm |
| 76 | 308.5 mm |

As shown in FIG. 2, in the present embodiment, the pickup roller 67 comes into contact with the sheet S at a contact position 77 distant from an inner wall surface 60*b* of the sheet feeding cassette 60 (reference restricting portion, position where a front edge of the sheet S is restricted) by a distance (sheet feeding range) $L_p$. The distance $L_p$ from the inner wall surface 60*b* of the sheet feeding cassette 60 to the contact position 77 is substantially equal to a distance from a downstream end in the sheet feeding direction F of the sheet S stored in the sheet feeding cassette 60 to the contact position 77 where the pickup roller 67 comes into contact with the sheet S in the present embodiment. Still further, the distance $L_p$ is substantially equal to a displacement of setting position of the rear end restricting member 63 where a sheet can be picked up as described later (referred to as a 'pickable displacement' hereinafter). Due to that, the sheet S can be fed even if the sheet S is displaced upstream in the sheet feeding direction F by the distance $L_p$ within the sheet feeding cassette 60. A value of this distance $L_p$ is set to be 15 mm in the present embodiment.

Before starting the feeding operation of the sheet S, the control portion 100 is required to perceive that the size of the sheet S inputted by the user through a personal computer or the operation portion 101 coincides with the size of the sheet detected by the sheet size detecting portion 66A and the user have actually stored in the sheet feeding cassette 60. Then, the sheet feeding operation is not started if the size of the inputted sheet S does not coincide with the size of the sheet S stored in the sheet feeding cassette 60.

By the way, even if the same size of sheet S with the inputted sheet S is stored in the sheet feeding cassette 60, there is a case where the user sets the rear end restricting member 63 not at a normal restricting position restricting the upstream end in the sheet feeding direction F of the sheet S but at an erroneous position. In this case, if the sheet feeding operation is performed in a state in which a displacement of setting position of the rear end restricting member 63 with respect to the normal restricting position exceeds a sheet feedable range, i.e., in a state exceeding 15 mm, a non-feeding error takes place. Or, even if the sheet S is fed, the sheet S is not fed normally, causing jamming and others. Due to that, the sheet feeding operation is not started when the sheet sizes are inconsistent.

Meanwhile, if the displacement of the setting position of the rear end restricting member 63 is a predetermined distance shorter than the distance to the position where the pickup roller 67 comes into contact with the sheet S, i.e., within 15 mm in the present embodiment, the sheet S can be fed. That is, even if the setting position of the rear end restricting member 63 is displaced, the sheet S can be fed if the displacement is within 15 mm.

Then, in the present embodiment, the control portion 100 is configured to be able to discriminate the size of the actually stored sheet even if the setting position of the rear end restricting member 63 is displaced if the displacement is within 15 mm. The control portion 100 is also configured be able to discriminate as a different sheet size if the displacement exceeds the sheet feedable displacement (15 mm). It is noted that in the present embodiment, the sheet size detecting portion 66A is configured to accurately detect the size of the stored sheet even if the position of the rear end restricting member 63 is displaced upstream in the sheet feeding direction F from the normal position by up to 11.5 mm by taking variations and other of sizes and assembly of mass-produced components into account. This arrangement makes it possible to start to feed the sheet S if the displacement of the setting position of the rear end restricting member 63 is within 11.5 mm.

Next, an operation for detecting the sheet size by the sheet size detecting portion 66A described above will be explained with reference to FIG. 4. As described above, FIG. 4 shows the state of the size detecting plate 65 and the sensor portion 66 in the case where the rear end restricting member 63 is set at the normal position after storing the A5 size sheet in the sheet feeding cassette 60. At this time, the switches SW1 and SW2 of the sensor portion 66 are OFF and the switch SW3 is ON. This is a switch pattern (1) shown in FIG. 6, and the control portion 100 discriminates the sheet size as the A5 size sheet in the case of this pattern. It is noted that in FIG. 6, a numeral 0 of the switch pattern indicates that the switch SW is ON and 1 indicates that the switch SW is OFF.

Here, in the present embodiment, the size detecting plate 65 is formed such that the switch SW2 is turned ON from a point where the rear end restricting member 63 is shifted by 11.5 mm from the normal position shown in FIG. 4 to an upstream side (to a left side in FIG. 4) in the sheet feeding direction F. The switch pattern at this time is a switch pattern (2) shown in FIG. 6. The control portion 100 discriminates the sheet size as the B5 size sheet in the case of this pattern. That is, in the present embodiment, the size detecting plate 65 is formed to permit to discriminate that the size of the sheet stored in the sheet feeding cassette 60 is the A5 size if the user has stored the A5 size sheet within the sheet feeding cassette 60 and if the displacement of the setting position of the rear end restricting member 63 is within 11.5 mm.

Meanwhile, differences between lengths of the B5 size sheet and the EXEC size sheet, of the EXEC size sheet and the 16K size sheet, and of the 16K size sheet and the LTR size sheet, i.e., differences of lengths to be read by the positions of the rear end restricting member 63, are less than 11.5 mm in the present embodiment. Due to that, it is unable to set a switching point like that set between the A5 size and the B5 size sheets.

Then, in the present embodiment, the sheet size detecting portion 66A is configured to be able to detect and discriminate the sheet sizes by using two switch patterns even if the difference of lengths of the sheets S is less than 11.5 mm. Specifically, the sheet sizes are judged by using not only a first switch pattern indicating that the rear end restricting member 63 is located at the normal position but also a second switch pattern indicating that the rear end restricting member 63 is located at a position upstream in the sheet feeding direction of the normal position by 11.5 mm.

Thereby, the first switch pattern is inputted to the control portion 100 when the rear end restricting member 63 is located at the normal restricting position and the second switch pattern is inputted to the control portion 100 when the rear end restricting member 63 is located at the position upstream of the restricting position by 11.5 mm (predetermined distance). Then, in the present embodiment, the first and the second switch patterns are set in a case of the sheets S of the EXEC, the 16K and the LTR. When one of the first and the second switch patterns of the EXEC size is thus inputted from the sheet size detecting portion 66A to the control portion 100, the control portion 100 judges that the sheet S of the EXEC size is stored. The sheets S of the 16K size and the LTR size are the same as respectively.

That is, the sheet size detecting portion 66A is configured to be able to detect a first position located at a position distant by a first distance set based on a length in the sheet feeding direction of the EXEC size (first size) sheet for example to the upstream side in the sheet feeding direction from the inner wall surface 60*b*, a second position distant to the upstream side in the sheet feeding direction from the inner wall surface 60*b* by a second distance longer than the first distance and a length in the sheet feeding direction of the 16K size (second size) sheet for example and shorter that a total distance of the length in the sheet feeding direction of the EXEC size and the sheet feeding range $L_p$, and a third position distant to the upstream side in the sheet feeding direction from the inner wall surface 60*b* by a third distance longer than the second distance and shorter than a total distance of the length in the sheet feeding direction of the 16K size sheet and the sheet feeding range $L_p$.

Then, in a case where the control portion 100 judges that the rear end restricting member 63 is located between the first and second positions based on a detection signal from the sheet size detecting portion 66A, the control portion 100 judges that the sheet size is the EXEC size if the sheet size specified by the user in advance is the EXEC size. The control portion 100 also correlates a range between the first and second positions redundantly with both of the EXEC size and the 16K size and judges that the sheet size is the 16K size if the sheet size specified by the user in advance is the 16K size in a case where the rear end restricting member 63 is judged to be located between the first and second positions based on of the detection signal from the sheet size detecting portion 66A.

That is, the sheet size detecting portion 66A can detect the position of the rear end restricting member 63 with respect to the cassette body 60*a*. The sheet size detecting portion 66A outputs the switch pattern (2) in the case where the rear end restricting member 63 is located at the normal position of the cassette body 60*a*, e.g., at a position restricting moves of the sheet S of the EXEC size. The sheet size detecting portion 66A also outputs the switch pattern (3) in a case where the rear end restricting member 63 is located at a position restricting moves of the sheet S of the EXEC size within a permissible range in which a position error with respect to the normal position is permissible. Still further, according to the present embodiment, the sheet size detecting portion 66A outputs the switch pattern (3) in a case where the sheet S of the 16K size for example that is larger than the EXEC size and smaller than the permissible range of the EXEC size is located at the normal position of the cassette body 60*a* and the rear end restricting member 63 is located at a position restricting move of the sheet S.

That is, the sheet size detecting portion 66A outputs the detection signals as follows, where the length of the sheet S of the EXEC size is L1, the length of the sheet S of the 16K size is L2 (>L1), the permissible range of the sheet S of the EXEC size is $L_p$, and $L2-L1<L_p$ for example. Firstly, the sheet size detecting portion 66A outputs the switch pattern (2) in a case where a position of the rear end restricting member 63 is more than the length L1 and less than the length L2 based on a downstream end in the sheet feeding direction of the sheet S stored in the cassette body 60*a*. The sheet size detecting portion 66A also outputs the switch pattern (3) in a case where the position of the rear end restricting member 63 is more than the length L2 and less than the length $L1+L_p$ based on the downstream end in the sheet feeding direction of the sheet S stored in the cassette body 60*a*.

Then, in a case where the sheet S of the EXEC size for example has been specified as the sheet S stored in the cassette body 60*a*, the control portion 100 judges that the sheet stored in the cassette body 60*a* is the sheet S of the EXEC size even if either one of the switch patterns (2) and (3) is outputted from the sheet size detecting portion 66A. The control portion 100 also judges that the sheet S stored in the cassette body 60*a* is the sheet S of the 16K size in the case where the switch pattern (3) is outputted from the sheet size detecting portion 66A in the case where the sheet S of the 16K size for example has been specified as the sheet S stored in the cassette body 60*a*.

Figure 7:
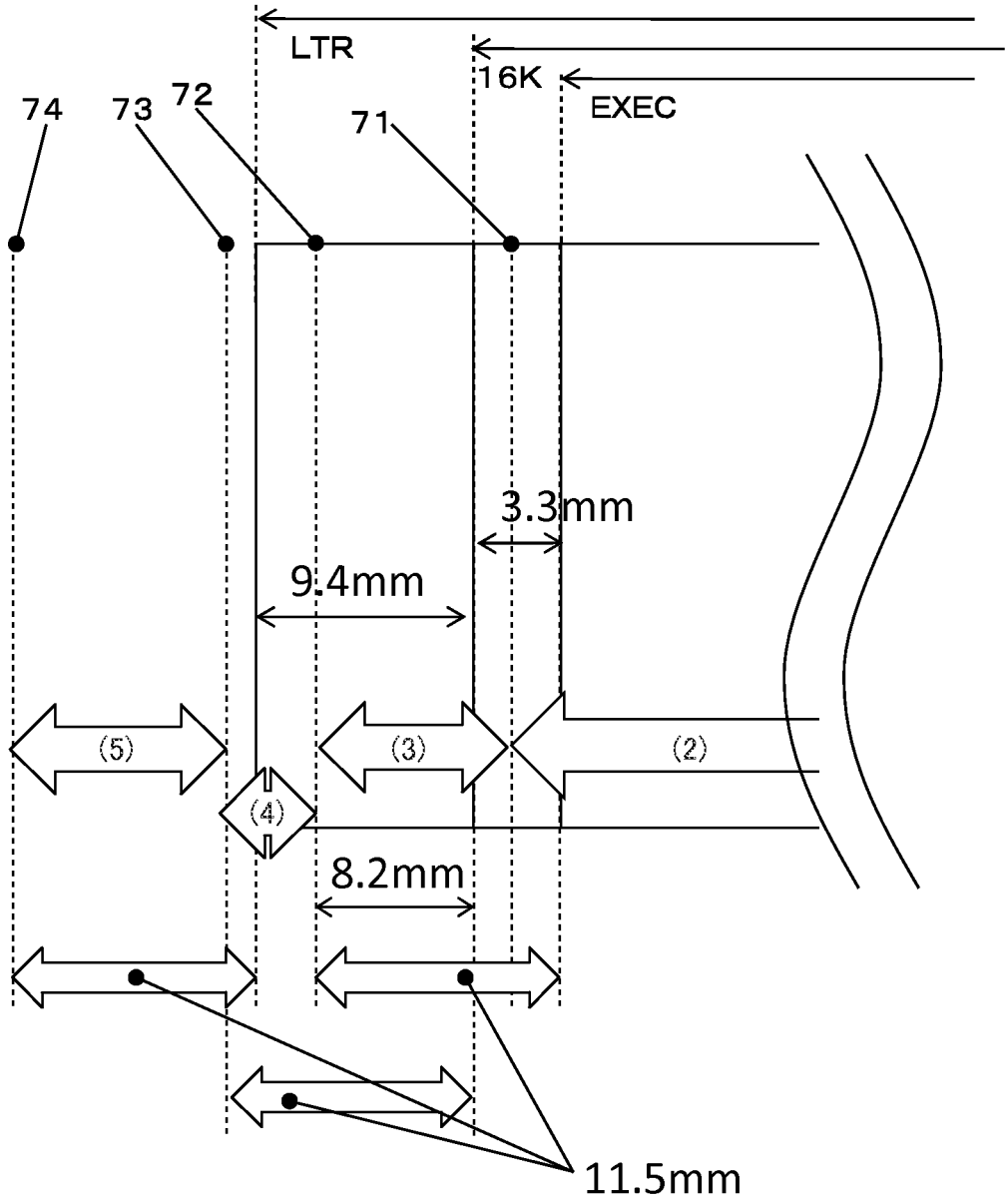
FIG. 7 is a diagram excerpting disposition of switch patterns of each sheet of EXEC, 16K, and LTR in the sheet size detecting portion.

FIG. 7 is a diagram excerpting the dispositions of the switch patterns of the respective sheets S of the EXEC, 16K and LTR sizes. As shown in FIG. 7, switch pattern switching points (referred to simply as 'switching points' hereinafter) 72, 73 and are set at positions distant by 11.5 mm from the positions where each sheet S of the EXEC, 16K and LTR sizes are normally set, respectively. It is noted that the switching points 72, 73 and 74 are different from those described above in Table 1.

That is, in a case where a difference of sheet lengths<the pickable displacement (15 mm), e.g., in a case of the EXEC size whose difference of sheet length with the 16K sheet is 3.3 mm, the switching point is set at the point 72 which is a position of the sheet length of the EXEC size+11.5 mm based on the inner wall surface 60*b*. Still further, in the case of the 16K size sheet whose difference of sheet lengths with the LTR size sheet is 9.4 mm, the switching point is set at the point 73 which is a position of the sheet length of the 16K size+11.5 mm based on the inner wall surface 60*b*. In the case of the LTR size, the switching point is set at the point 74 which is a position of the sheet length of the LTR size+11.5 mm based on the inner wall surface 60*b*.

The switching points are thus set by the sheet length+11.5 mm in the present embodiment. Still further, in detecting the sheet sizes in the present embodiment, ABK, inch and complex series are set through the PC or the operating portion 101. Table specifically shows those settings. It is noted that a most detected setting in Table 2 is the complex series of the ABK and inch series and is setting that permits to detect most sheet sizes in the present embodiment. Here, as shown in Table 2, no discrimination of the EXEC and 16K sizes is made in the case of the most detected setting, only the A5, B5, 16K and A4 sizes are discriminated in the cases of the ABK series setting, and only the EXEC, LTR and LGL sizes are discriminated in the case of the inch series setting.

TABLE 2

| Size Direction (Length in Conveying Direction) | Most Detected Setting | ABK Series Setting | Inch Series Setting |
|---|---|---|---|
| A5 (210 mm) | (1) | (1) | — |
| B5 (257 mm) | (2) | (2) | — |
| EXEC (266.7 mm) | — | — | (2) (3) |
| 16K (270 mm) | — | (3) (4) | — |
| LTR (279.4 mm) | (4) (5) | — | (4) (5) |
| A4 (297 mm) | (6) | (6) | — |
| LGL (355.6 mm) | (7) | — | (7) |

The control portion 100 includes a plurality of size groups composed of a plurality of sizes such that a difference of lengths in the sheet feeding direction between the adjacent size sheets is greater than the length in the sheet feeding direction of the sheet feeding range $L_p$. Then, the control portion 100 is configured to select one size group among the plurality of size groups based on a sheet size specified in advance and to discriminate the sheet size from the sizes in the selected size group.

In the case where the sheet size specified in advance is the EXEC size, the control portion 100 selects the inch series setting (first size group) in which the range between the first and second positions is correlated with the EXEC size among the plurality of size groups, and judges that the stored sheet S is the EXEC size when it is judged that the rear end restricting member 63 is located between the first and second positions based on the detection signal from the sheet size detecting portion 66A.

In the case where the sheet size specified in advance is the 16K size, the control portion 100 selects the ABK series setting (second size group) in which the range between the first and second positions is correlated with the 16K size among the plurality of size groups, and judges that the stored sheet S is the 16K size when it is judged that the rear end restricting member 63 is located between the first and second positions based on the detection signal from the sheet size detecting portion 66A That is, the control portion 100 sets a plurality of size groups each including a plurality of sizes. The plurality of sizes in one size group has a relationship in which one size is not contained in a permissible range of another size. The size groups described above include the ABK series setting including the 16K size and the inch series setting including the EXEC size for example. Then, the control portion 100 is configured to judge a size of the sheet S among the selected size group based on the detection signal outputted out of the sheet size detecting portion 66A.

Next, an operation for detecting a sheet size in the present embodiment will be explained. After storing the sheet S in the sheet feeding cassette 60, the user specifies a size of the sheet S stored in the sheet feeding cassette 60 in advance by operating an operation panel not shown of the operating portion (specifying portion) 101. With this specification, the control portion 100 determines that the detection of the size of the sheet S should be performed by which one of the inch series, the ABK series and the most detected setting.

In a case where the EXEC size sheet has been stored for example, the control portion 100 discriminates the sheet size in the setting of the inch series in accordance to the specification of the sheet size made by the user. Then, in a case where the dispositions of the switch patterns as shown in FIG. 6 result, the control portion 100 discriminates that the stored sheet S is the EXEC size sheet when the switch pattern (2) or (3) is inputted from the sheet size detecting portion 66A. In a case where the 16K size sheet is stored, the control portion 100 discriminates the sheet size in the setting of the ABK series in accordance to the specification of the sheet size made by the user. Then, when the switch pattern (3) or (4) is inputted from the sheet size detecting portion 66A, the control portion 100 discriminates that the stored sheet S is the 16K size sheet. In a case where the LTR size sheet is stored, the control portion 100 discriminates the sheet size in the most detected setting or in the setting of the inch series in accordance to the specification of the sheet size made by the user. Then, when the switch pattern (4) or (5) is inputted from the sheet size detecting portion 66A, the control portion 100 discriminates that the stored sheet S is the LTR size sheet.

As described above, according to the present embodiment, in the case the EXEC size sheet is stored, the control portion 100 sets the inch series and discriminates the EXEC size sheet by using the switch pattern (3) other than the original switch pattern (2). In the case where the 16K size sheet is stored, the control portion 100 sets the ABK series and discriminates the size by using the switch pattern (4) other than the original switch pattern (3). In the case where the LTR size sheet is stored, the control portion 100 sets the most detected setting or the inch series and discriminates the size by using the switch pattern (5) other than the switch pattern (4).

In other words, according to the present embodiment, in the case of the inch series setting in which the EXEC size and LTR size sheets are detected and no 16K size sheet is detected, the control portion 100 discriminates the stored sheet S as the EXEC size sheet in the case where the switch pattern is the switch pattern (2) or (3) and as the LTR size sheet in the case where the switch pattern is the switch pattern (4) or (5). Meanwhile, in the case of the ABK series setting in which no EXEC and LTR size sheets are detected and the 16K size sheet is detected, the control portion 100 discriminates the stored sheet S as the 16K size sheet in the case where the switch pattern is the switch pattern (3) or (4).

Figure 8A:
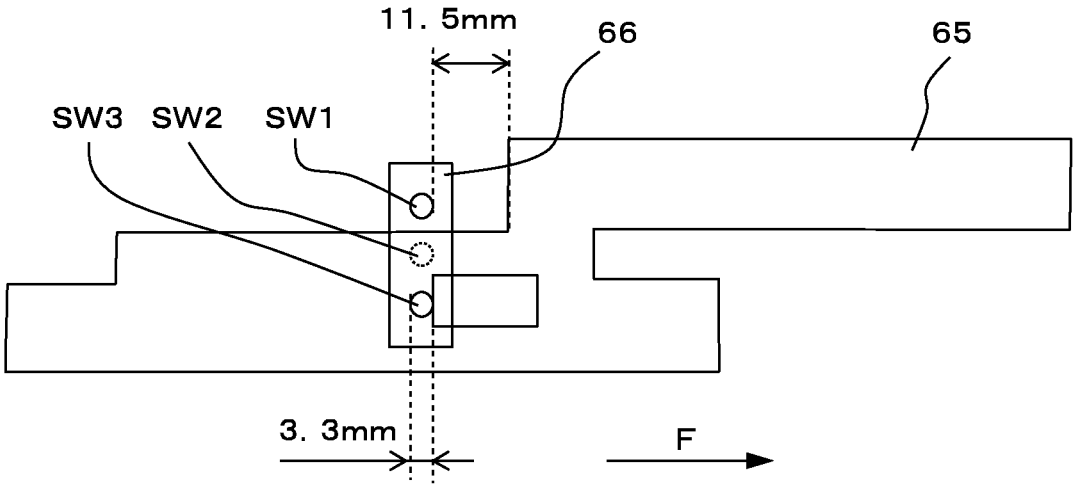
FIG. 8A is a diagram illustrating the disposition of the size detecting plate and the three switches of the sensor portion in a switch pattern (2) of the sheet size detecting portion.
Figure 8B:
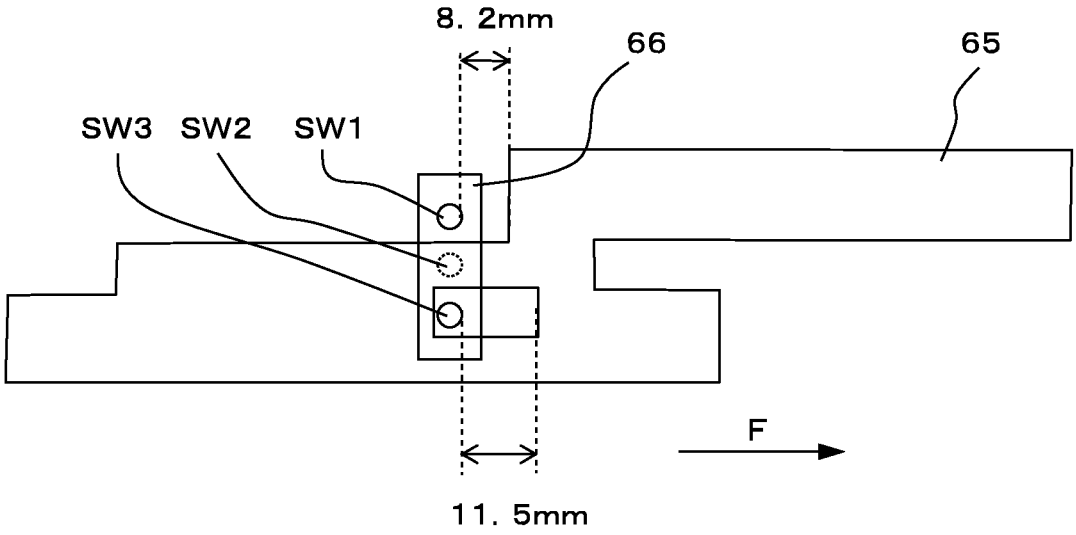
FIG. 8B is a diagram illustrating the disposition of the size detecting plate and the three switches of the sensor portion in a switch pattern (3) of the sheet size detecting portion.

FIGS. 8A and 8B are diagrams illustrating dispositions of the size detecting plate 65 of the sheet size detecting portion 66A and of the three switches SW1, SW2 and SW3 of the sensor portion 66 for detecting the sheet sizes as described above. It is noted that FIGS. 8A and 8B are excerpts of only positional relationships of the size detecting plate 65 and the three switches SW1, SW2 and SW3 of the sensor portion 66 in the EXEC size and 16K size sheets from FIG. 7.

FIG. 8A shows a state in which the switch SW1 is OFF and the switches SW2 and SW3 are ON. This switch pattern is what generated when the rear end restricting member 63 is set at the normal position when the EXEC size sheet is stored and is the switch pattern (2) in FIG. 6. The control portion 100 discriminates that the EXEC size sheet is stored by this switch pattern.

Here, if the rear end restricting member 63 is shifted upstream in the sheet feeding direction F by 3.3 mm from the normal position as shown in FIG. 8B, the switch SW3 is turned OFF and the switch pattern changes to the switch pattern (3) as indicated in FIG. 6. However, in the case where the inch series in which the EXEC size sheet can be discriminated is set, the control portion 100 judges that the EXEC size sheet is stored even if the switch pattern changes to the switch pattern (3).

In the case where the inch series is thus set, the control portion 100 discriminates the stored sheet S as the EXEC size sheet whichever the switch pattern is, i.e., either the switch pattern (2) or (3). It is noted that the discrimination is changed when the switch pattern enters the switch pattern (4). That is, as shown in FIG. 7, a boundary between the switch patterns (3) and (4) is set at a position of the length of the EXEC size sheet+11.5 mm in the present embodiment. This arrangement makes it possible to permit the displacement of the setting position of the rear end restricting member 63 up to 11.5 mm similarly to the A5 size sheet.

The switch pattern changes from the switch pattern (3) to the switch pattern (4) only by shifting the rear end restricting member 63 by 8.2 mm similarly also in the case of the 16K size sheet, the control portion 100 discriminates the sheet as the 16K size sheet even if the switch pattern changes from the switch pattern (3) to the switch pattern (4) because the ABK series is set in this case. This arrangement makes it possible to permit the displacement of the setting position of the rear end restricting member 63 when the 16K size sheet is stored up to 11.5 mm. The same applies also to the LTR size sheet.

It is possible to permit the displacement of the setting position of the rear end restricting member 63 up to 11.5 mm for all of the sizes of sheets by performing the detection of the sheet sizes as described above. Accordingly, it is possible to reduce an occurrence of feeding error and the like otherwise caused by the erroneous setting of the rear end restricting member 63 made by the user.

Here, in the present embodiment, the switching points 72, 73 and 74 are set at the positions where the rear end restricting member 63 is moved upstream in the sheet feeding direction F by 11.5 mm (predetermined distance) from the normal position corresponding to the rear end of all of the EXEC size, 16K size, and LTR size sheets, respectively. However, this value, i.e., 11.5 mm, needs not to be the same value for each sheet S of the EXEC size, 16K size, and LTR size sheets and may be a value that permits to feed the sheet S even if a displacement of setting position of the rear end restricting member 63 is generated.

Figure 9:
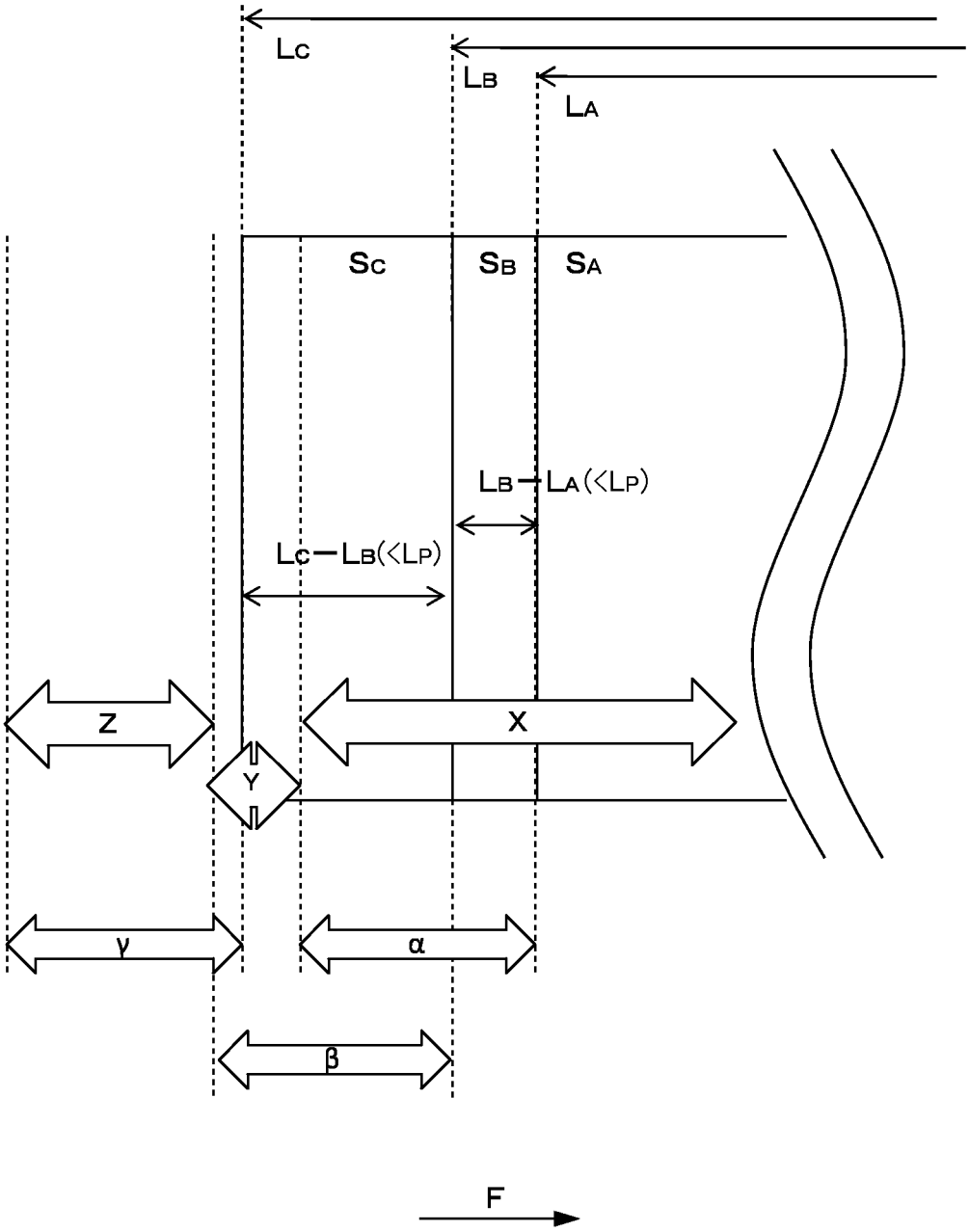
FIG. 9 is a diagram schematically illustrating a detecting operation of the sheet size detecting portion.

That is, if a shift (predetermined distance) of the switching point 72 with respect to the normal position is denoted as $\alpha$, a shift of the switching point 73 with respect to the normal position is denoted as $\beta$, and a shift of the switching point 74 with respect to the normal position is denoted as $\gamma$ as shown in FIG. 9, $\alpha$, $\beta$ and $\gamma$ may be values that satisfy the following equations (1) through (3). It is noted that the values of the $\alpha$, $\beta$ and $\gamma$ are preferable to be 11.5 mm as described above.

Difference of sheet lengths between EXEC and 16K (3.3 mm)$<\alpha<$Pickable displacement of sheet position (15 mm) Eq. (1)

Difference of sheet lengths between 16K and LTR (9.4 mm)$<\beta<$Pickable displacement of sheet position (15 mm) Eq. (2)

$\gamma<$Pickable displacement of sheet position (15 mm) Eq. (3)

FIG. 9 is a diagram schematically illustrating the detecting operation of the sheet size detecting portion 66A of the present embodiment described above. In FIG. 9, $S_A$, $S_B$ and $S_C$ denote different sizes of sheets and $L_A$, $L_B$ and $L_C$ denote lengths of the sheets $S_A$, $S_B$ and $S_C$. $\alpha$, $\beta$ and $\gamma$ denote the shifts larger than the difference between the two sheet lengths and smaller than $L_p$, i.e., the pickable displacement, by a predetermined length as expressed by the equations (1) through (3) described above.

$L_A+\alpha$, $L_B+\beta$, and $L_C+\gamma$ indicate positions of the rear end restricting member 63 where the switch patterns are switched in a case where a relationship of $L_B-L_A$ and $L_C-L_B$ is $L_B-L_A<L_P$ and $L_C-L_B<L_P$. In this case, $\alpha$, $\beta$ and $\gamma$ result in as $L_B-L_A<\alpha<L_P$, $L_C-L_B<\beta<L_P$, and $\gamma<L_P$.

X is a switch pattern detected when the rear end restricting member 63 is located at a position less than $L_A+\alpha$ based on the inner wall surface 60*b*. Y is a switch pattern when the rear end restricting member 63 is located at a position more than $L_A+\alpha$ and less than $L_B+\beta$ based on the inner wall surface 60*b*. Z is a switch pattern when the rear end restricting member 63 is located at a position more than $L_B+\beta$ and less than $L_C+\gamma$ based on the inner wall surface 60*b*.

Then, the control portion 100 specifies that the stored sheet S belongs to either one of the ABK series, the inch series and the most detected setting in advance by the input of a type (size) of the sheet S stored in the sheet feeding cassette 60 inputted by the user through the operating portion 101. If the sheets $S_A$ and $S_C$ are specified in advance and the sheet $S_B$ is not specified in advance at this time, the control portion 100 discriminates the stored sheet S as the sheet $S_A$ when the switch pattern is the switch pattern X and discriminates as the sheet size $S_C$ when the switch pattern is the switch pattern Y or Z. Still further, if the sheets $S_A$ and $S_C$ are not specified in advance and when the sheet $S_B$ is specified in advance, the control portion 100 discriminates the stored sheet as the sheet $S_B$ when the switch pattern is the switch pattern X or Y.

As described above, according to the present embodiment, the control portion 100 judges the sizes of the sheet S by the ON and OFF patterns of the plurality of switches SW1, SW2, and SW3 inputted from the sheet size detecting portion 66A. Then, when the size of the sheet S is specified through the operating portion 101, the control portion 100 judges that the size of the sheet S stored in the sheet feeding cassette 60 is the size of the sheet S specified through the operating portion 101 even if the pattern is the second pattern different from the first pattern.

This arrangement makes it possible to judge that the size of the sheet S is the size of the sheet S specified through the operating portion 101 even if the setting position of the rear end restricting member 63 is displaced. As a result, it is possible to enlarge a region where the sheet S set by the user can be correctly detected and to provide the full-color laser beam printer (image forming apparatus) 1 having a large allowance to the displacement of the rear end restricting member 63. That is, it is possible to increase the allowance to the displacement of the setting position of the rear end restricting member 63 by judging as a size of a specified sheet S even if the pattern of ON and OFF of the switches is a predetermined pattern different from a pattern of the size of the specified sheet S.

It is noted that the case where the size of the sheet S stored in the sheet feeding cassette 60 is specified through the operating portion 101 has been described above, the present invention is not limited such a case and it is possible to arrange such that the size of the sheet S is specified by using a personal computer as the specifying portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-002467, filed Jan. 9, 2014 which is hereby incorporated by reference herein in its entirety.

What is claimed is:

1. An image forming apparatus comprising:

an apparatus body;

a sheet storing portion including:

a sheet storage body configured to be attachable to the apparatus body and configured to store a different sizes of sheets; and a movable restricting portion disposed in the sheet storage body to be movable along a sheet feeding direction and restricting an upstream end in the sheet feeding direction of the sheet;

a sheet feeding portion configured to feed the sheet stored in the sheet storing portion;

a specifying portion configured to specify the size of the sheet stored in the sheet storing portion;

a detecting portion including:

a plurality of switches provided in the apparatus body and a detecting member provided in the sheet storing portion, moving in conjunction with the movable restricting portion and turning ON and OFF the plurality of switches in the state in which the sheet storing portion is attached to the apparatus body; and a control portion judging the size of the sheet by patterns of ON and OFF of the plurality of switches inputted from the detecting portion and judging that the size of the sheet stored in the sheet storing portion is the size of the sheet specified through the specifying portion in a case where the size of the sheet is specified by the specifying portion even if the pattern is a predetermined pattern different from a pattern of the size of the sheet specified by the specifying portion, wherein the control portion starts a sheet feeding operation of the sheet feeding portion in a case where the size of the sheet stored in the sheet storing portion is the size of the sheet specified through the specifying portion.

2. The image forming apparatus according to claim 1, wherein the predetermined pattern is a pattern resulting in a case where the movable restricting portion is located at a position shifted upstream in the sheet feeding direction by a predetermined distance shorter than a distance from a downstream end in the sheet feeding direction of the sheet stored in the sheet storing portion to a position where the sheet feeding portion comes into contact with the sheet with respect to a normal restricting position restricting an upstream end in the sheet feeding direction of the sheet specified by the specifying portion.

3. The image forming apparatus according to claim 2, wherein, the control portion discriminates, in a case where sheets $S_A$ and $S_C$ are to be detected and a sheet $S_B$ is not to be detected by the specification made through the specifying portion, that the stored sheet is the sheet $S_A$ in a case where the pattern is a pattern X and discriminates that the stored sheet is the sheet $S_C$ in a case where the pattern is a pattern Y or Z and discriminates that the stored sheet is the sheet $S_B$ in a case where the pattern is the pattern X or Y in a case where the sheets $S_A$ and $S_C$ are not to be detected and the sheet $S_B$ is to be detected, where lengths of stored different sizes of the sheets $S_A$, $S_B$ and $S_C$ are denoted as $L_A$, $L_B$ and $L_C$, an upstream shift in the sheet feeding direction of a sheet that can be fed is denoted as $L_P$, $L_B - L_A < L_P$ and $L_C - L_B < L_P$, and the predetermined distances are denoted as α, β and γ, respectively, α, β and γ are expressed as $L_B - L_A < \alpha < L_P$, $L_C - L_B < \beta < L_P$, and $\gamma < L_P$, and where the ON and OFF pattern of the plurality of switches in a case where the movable restricting portion is located at a position less than $(L_A + \alpha)$ based on the downstream end in the sheet feeding direction of the sheet stored in the sheet storing portion is denoted as the pattern X, the pattern in a case where the movable restricting portion is located at a position more than $(L_A + \alpha)$ and less than $(L_B + \beta)$ is denoted as the pattern Y, and the pattern in a case where the movable restricting portion is located at a position more than $(L_B + \beta)$ and less than $(L_C + \gamma)$ is denoted as the pattern Z.

4. The image forming apparatus according to claim 1, wherein one of sheet sizes in an ABK series and an inch series is specified through the specifying portion.

5. An image forming apparatus comprising:

an apparatus body;

a sheet storing portion configured to be attachable to the apparatus body, capable of storing a plurality of sizes of sheets including a first size and a second size larger than the first size, and including a reference restricting portion restricting a downstream end in the sheet feeding direction of the sheet;

a sheet feeding portion configured to feed a sheet stored in the sheet storing portion in a state in which a downstream end in the sheet feeding direction of the sheet is located within a sheet feeding range having a predetermined length upstream in the sheet feeding direction from the reference restricting portion;

a movable restricting portion disposed within the sheet storing portion to be movable upstream and downstream in the sheet feeding direction and restricting an upstream end in the sheet feeding direction of a sheet;

a detecting portion configured to be able to detect a position in the sheet feeding direction of the movable restricting portion, the detecting portion being configured to be able to detect:

a first position located at a position distant by a first distance set based on a length in the sheet feeding direction of the first size upstream in the sheet feeding direction from the reference restricting portion;

a second position distant upstream in the sheet feeding direction from the reference restricting portion by a second distance longer than the first distance and a length in the sheet feeding direction of the second size and shorter than a total distance of the length in the sheet feeding direction of the first size and a length of the sheet feeding range; and a third position distant upstream in the sheet feeding direction from the reference restricting portion by a third distance longer than the second distance and shorter than a total distance of the length in the sheet feeding direction of the second size and the length of the sheet feeding range; and a control portion configured to judge that the sheet size is the first size in a case where the sheet size specified by a user in advance is the first size and the movable restricting portion is judged to be located between the first and second positions based on a detection signal from the detecting portion, wherein the control portion starts a sheet feeding operation of the sheet feeding portion in a case where the size of the sheet stored in the sheet storage portion is the size of the sheet specified in advance.

6. The image forming apparatus according to claim 5, wherein the control portion correlates the range between the first and second positions redundantly with both of the first and second sizes and judges that the sheet size is the second size in a case where the size of the sheet specified in advance is the second size in a case where it is judged that the movable restricting portion is located between the first and second positions based on the detection signal from the detecting portion.

7. The image forming apparatus according to claim 5, wherein the first and second sizes are set such that a difference of the lengths in the sheet feeding direction is shorter than a length in the sheet feeding direction of the sheet feeding range, wherein the control portion has a plurality of size groups composed of a plurality of sizes composed such a difference of lengths in the sheet feeding direction between adjacent sizes is greater than a length in the sheet feeding direction of the sheet feeding range, and is configured to select one size group among the plurality of size groups based on a sheet size specified in advance and to judge the sheet size among the selected size group, wherein the control portion selects a first size group in which the range between the first and second positions is correlated with the first size in a case where the sheet size specified in advance is the first size and judges that the stored sheet is the first size in a case where the movable restricting portion is judged to be located between the first and second positions based on the detection signal from the detecting portion, and wherein the control portion selects a second size group in which the range between the first and second positions is correlated with the second size in a case where the sheet size specified in advance is the second size and judges that the stored sheet is the second size in a case where the movable restricting portion is judged to be located between the first and second positions based on the detection signal from the detecting portion.

8. The image forming apparatus according to claim 7, wherein the first size group is a size group of an inch series sheets and the second size group is a size group of an ABK series sheets.

9. The image forming apparatus according to claim 5, further comprising a specifying portion specifying the size of the sheet stored in the sheet storage portion under operation of the user.

10. The image forming apparatus according to claim 5, wherein the detecting portion includes:

a plurality of switches; and a detecting member turning ON and OFF the plurality of switches by moving in conjunction with the movable restricting portion; the detecting portion outputting the detection signal by patterns of ON and OFF of the plurality of switches.

11. The image forming apparatus according to claim 10, wherein, the control portion discriminates, in a case where sheets $S_A$ and $S_C$ are specified in advance and a sheet $S_B$ is not specified in advance, that the stored sheet is the sheet $S_A$ in a case where the pattern is a pattern X, discriminates that the stored sheet is the sheet $S_C$ in a case where the pattern is pattern Y or Z, and discriminates that the stored sheet is the sheet $S_B$ in a case where the pattern is the pattern X or Y in a case where the sheets $S_A$ and $S_C$ are not specified in advance and the sheet $S_B$ is specified in advance, where lengths of stored different sizes of the sheets $S_A$, $S_B$ and $S_C$ are denoted as $L_A$, $L_B$ and $L_C$, the sheet feeding range is denoted as $L_P$, $L_B - L_A < L_P$ and $L_C - L_B < L_P$, and the predetermined distances shorter than the sheet feeding range are denoted by $\alpha$, $\beta$ and $\gamma$, $\alpha$, $\beta$ and $\gamma$ are expressed as $L_B - L_A < \alpha < L_P$, $L_C - L_B < \beta < L_P$, and $\gamma < L_P$, and where the ON and OFF pattern of the plurality of switches in a case where the movable restricting portion is located at a position less than $(L_A + \alpha)$ based on the downstream end in the sheet feeding direction of the sheet stored in the sheet storing portion is denoted as the pattern X, the pattern in a case where the movable restricting portion is located at a position more than $(L_A + \alpha)$ and less than $(L_B + \beta)$ is denoted as the pattern Y, and the pattern in a case where the movable restricting portion is located at a position more than $(L_B + \beta)$ and less than $(L_C + \gamma)$ is denoted as the pattern Z.

12. The image forming apparatus according to claim 5, further comprising a specifying portion configured to specify a size of a sheet stored in the sheet storage portion, wherein the control portion controls based on a specification of the size specified by the specifying portion.

* * * * *